United States Patent [19]

McCoy

[11] 4,321,008

[45] Mar. 23, 1982

[54] WIDE RANGE COMPRESSOR

[75] Inventor: Allan W. McCoy, Scottsdale, Ariz.

[73] Assignee: The Garrett Corporation, Los Angeles, Calif.

[21] Appl. No.: 95,706

[22] Filed: Nov. 16, 1979

[51] Int. Cl.[3] ..... F04D 29/46; F04D 29/56

[52] U.S. Cl. ..... 415/157; 415/160

[58] Field of Search ..... 60/226 B, 226 R; 415/77, 78, 157, 160, 161, 185, 191, 151, 143, 158

[56] References Cited

U.S. PATENT DOCUMENTS

| | | | |
|---|---|---|---|
| 483,394 | 9/1892 | Seelye | 415/157 |
| 1,748,768 | 2/1930 | Hofmann | 415/160 |
| 1,846,379 | 2/1932 | Anderson | 415/157 |
| 2,771,239 | 11/1956 | Moreillon | 415/157 |
| 2,797,044 | 6/1957 | Lovesey | 415/161 |
| 3,045,894 | 7/1962 | Ross | 415/157 |
| 3,066,488 | 12/1962 | Mock | 60/39.24 |
| 3,449,914 | 6/1964 | Brown | 60/226 B |
| 3,611,724 | 10/1971 | Kutney | 60/226 R |
| 3,659,418 | 5/1972 | Poucher et al. | 60/39.29 |

FOREIGN PATENT DOCUMENTS

| | | | |
|---|---|---|---|
| 2031069 | 4/1980 | United Kingdom | 415/78 |

*Primary Examiner*—Louis J. Casaregola

*Attorney, Agent, or Firm*—Herschel C. Omohundro; J. Richard Konneker; Albert J. Miller

[57] ABSTRACT

This wide range compressor has a casing forming a passage with an inlet and an axial portion, and a rotor with blades extending into the passage and functioning, when the rotor operates, to draw air into the inlet and force it through the passage. One of the problems with wide range compressors is a variation of the pressure as the volume changes rather than maintaining a desired constant or substantially constant discharge pressure. To solve this problem, the present compressor is provided, first, with a ring in the inlet to divide the flow into inner and outer annuluses and, second, with vane or other elements positioned and operative to vary one of the flow annuluses to maintain the output pressure of the compressor substantially uniform over the complete range. The concept embodied in the additional structure disclosed herein is applicable to fans, blowers, compressors, and pumps of axial, centrifugal, or mixed flow configurations which often have difficult wide range requirements.

26 Claims, 6 Drawing Figures

WIDE RANGE COMPRESSOR

BACKGROUND OF THE INVENTION

This invention relates generally to rotary mechanisms and more particularly to the class of mechanisms designated as turbomachinery. Still more particularly, the invention is concerned with the compressor portions of turbomachinery, especially wide range fans and compressors.

The present invention is directed to the class of rotary machines exemplified by the following U.S. Pat. Nos.: 483,394 Seelye Sept. 27, 1892, 1,748,768 Hofmann Feb. 25, 1930, 1,846,379 Anderson Feb. 23, 1932, 2,771,239 Moreillon Nov. 20, 1956, 2,797,044 Lovesey June 25, 1957, 3,066,488 Mock Dec. 4, 1962, 3,611,724 Kutney Oct. 12, 1971, 3,659,418 Poucher May 2, 1972.

The listed patents show rotary machines of various types for moving incompressible as well as compressible fluids, with a variety of mechanisms for controlling the volume, the pressure, and other characteristics of the output of the machines. While the machines shown in the listed patents may embody some of the elements of the present invention, none shows the complete combination nor do they show mechanisms for accomplishing the objectives of the present invention which include system requirements of fans and compressors for special air moving applications having a need for a wide range of pressure-flow deliveries with virtually constant discharge pressure.

SUMMARY OF THE INVENTION

The present invention resides in the provision of a wide range compressor having means for stabilizing the operation of the compressor while producing a wide range of volumes.

An object of the invention is to provide a compressor designed to produce a pressure-flow delivery over a wide flow range with virtually constant discharge pressure.

Still another object of the invention is to provide a compressor with variable components which may be controlled to produce the desired output; such variable components may include, but not be limited to, guide vanes, rotor blades, and throttle devices which may be used with varying degrees of effectiveness.

A further object of the invention is to provide a compressor having a casing in which a passage is formed, the passage having an inlet and receiving the blades of a rotor journalled in the casing, operation of the rotor causing the blades to draw air into the inlet and force it through the passage, means being disposed in the casing to vary the characteritics of the flow in the passage in a predetermined manner to produce desired results.

A still further object is to provide the compressor mentioned in the preceding object with stall ring means adjacent the inlet to promote stable recirculation of excess flow when the compressor is at low flow stage of operation and to supplement the stall ring with guide vanes which are located in predetermined regions and made variable to secure desired control characteristics.

Another object is to provide the compressor mentioned in the preceding paragraph with a stall ring disposed in the inlet to divide the fluid entering the passage into inner and outer flow annuluses and to dispose variable inlet guide vanes between the stall ring and the inner wall of the passage, means being provided in the casing to adjust the inlet guide vanes to vary the angle of flow of air admitted to the blades of the rotor for the purpose of controlling compressor pressure rise, capacity, and efficiency.

An object also is to provide a centrifugal compressor having variable geometry to improve the efficiency at low flow operation, an example of such variable geometry being a shroud section which is adjustable to control the area of flow of fluid to the rotor blades.

Other objects and advantages will become apparent to those skilled in the art from a reading of the following description of the forms of the invention selected for illustration in the accompanying drawings.

IN THE DRAWINGS

DESCRIPTION

Figure 1:
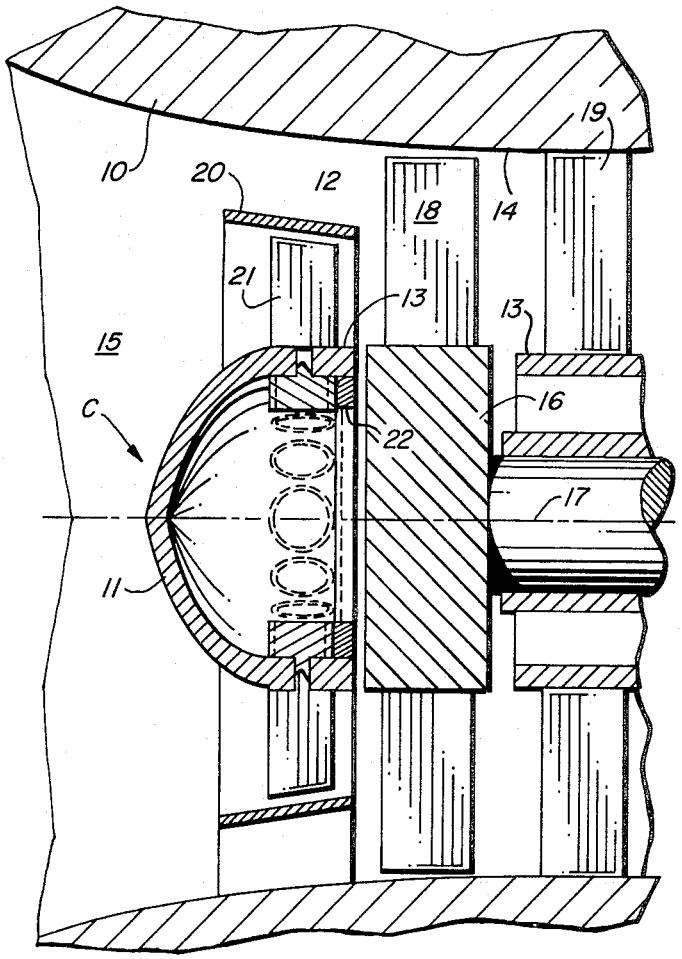
FIG. 1 is a partial axial sectional view of a compressor formed in accordance with the present invention.

More particular reference to FIG. 1 of the drawings shows that one form of the invention includes a compressor "C" of the axial type having casing means 10 and 11 providing a passage 12 with inner and outer walls 13 and 14. These walls are curved away from one another at the front of the casing to form an inlet 15 which communicates with an axially extending portion leading to an outlet or to other stages of compression. The compressor includes a rotor 16 mounted for rotation about an axis 17 extending substantially parallel to the passage 12, the rotor being provided with blades 18 which project into the passage 12. The blades are so shaped that when the rotor revolves under the action of a prime mover (not shown), fluid, such as ambient air, will be drawn into the inlet 15 and forced through the passage 12 to the outlet or succeeding stages of compression. Downstream from the rotor blades the passage 12 contains one or more rows of stator vanes 19 which extend betwen the inner and outer passage walls 13 and 14, respectively, and are disposed at suitable angles to diffuse the air flowing from the blades and cause a pressure increase. When the demand for air is low, the pressure increase causes a build up of fluid in the passage 12 and the air, or other fluid, tends to flow back toward the inlet or recirculate and result in a stall condition.

To combate such condition, it has heretofore been proposed to provide the inlet with a stall ring 20 which is relatively thin compared to its length axially and serves to split the fluid drawn in by the fan blades into inner and outer annuluses of flow. This stall ring tends to stabilize the operation of axial fans below normal stall by allowing recirculation of excess flow.

To facilitate control of the fan characteristics to match flow conditions, the compressor of this invention has partial span inlet guide vanes 21 in combination with the stall ring 20. As shown in FIG. 1, the inlet guide vanes 21 extend from the inner passage wall 13 substantially to the inner surface of the stall ring 20. The guide vanes 21 are mounted for pivotal adjustment about axes extending radially relative to the axis 17 of the rotor. Each vane 21 has a pinion or sector thereof secured thereto for meshing engagement with a ring gear 22 supported in the casing for rotary action in response to suitable control means (not shown) to effect adjustment of the guide vanes. In this manner the guide vanes may be moved to vary the angle at which the vanes direct the entering air against the rotating blades 18. It will be apparent that since the guide vanes are disposed between the stall ring and the inner wall of the passage, adjustment of such vanes will change predetermined characteristics of the inner annulus of flow. The control resulting from the mechanism of the invention provides a stable operating range of the fan.

Figure 2:
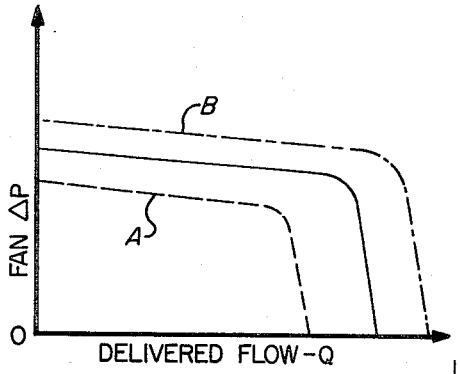
FIG. 2 is a graph with curves resulting from plotting the fan delivery pressure relative to the flow and indicating in solid, dotted, and dashed lines the results of predetermined adjustments of control mechanism provided in the compressor shown in FIG. 1.
Figure 4:
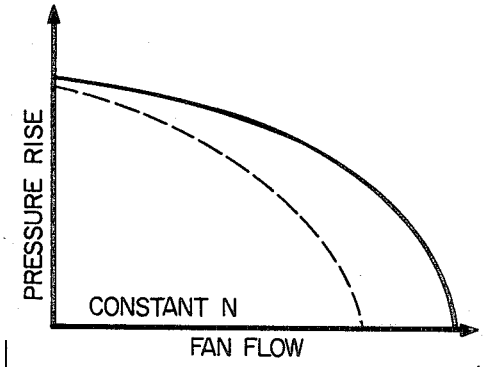
FIG. 4 is a graph with curves resulting from plotting the fan delivery pressure relative to the fan flow and indicating in solid and dashed lines the results of certain adjustments of geometry changing mechanisms shown in FIG. 3.

At low flows, positions of the inlet guide vanes at minus settings will control the fan pressure rise and provide reduction of the recirculation flow as indicated by the dotted line "A" in FIG. 2. The use of "plus" inlet guide settings increases maximum capacity of a given size fan as indicated by the dot-dash line "B" in FIG. 2 and indirectly contributes to low-flow efficiency by allowing use of a smaller fan size for given flow requirements.

Figure 3:
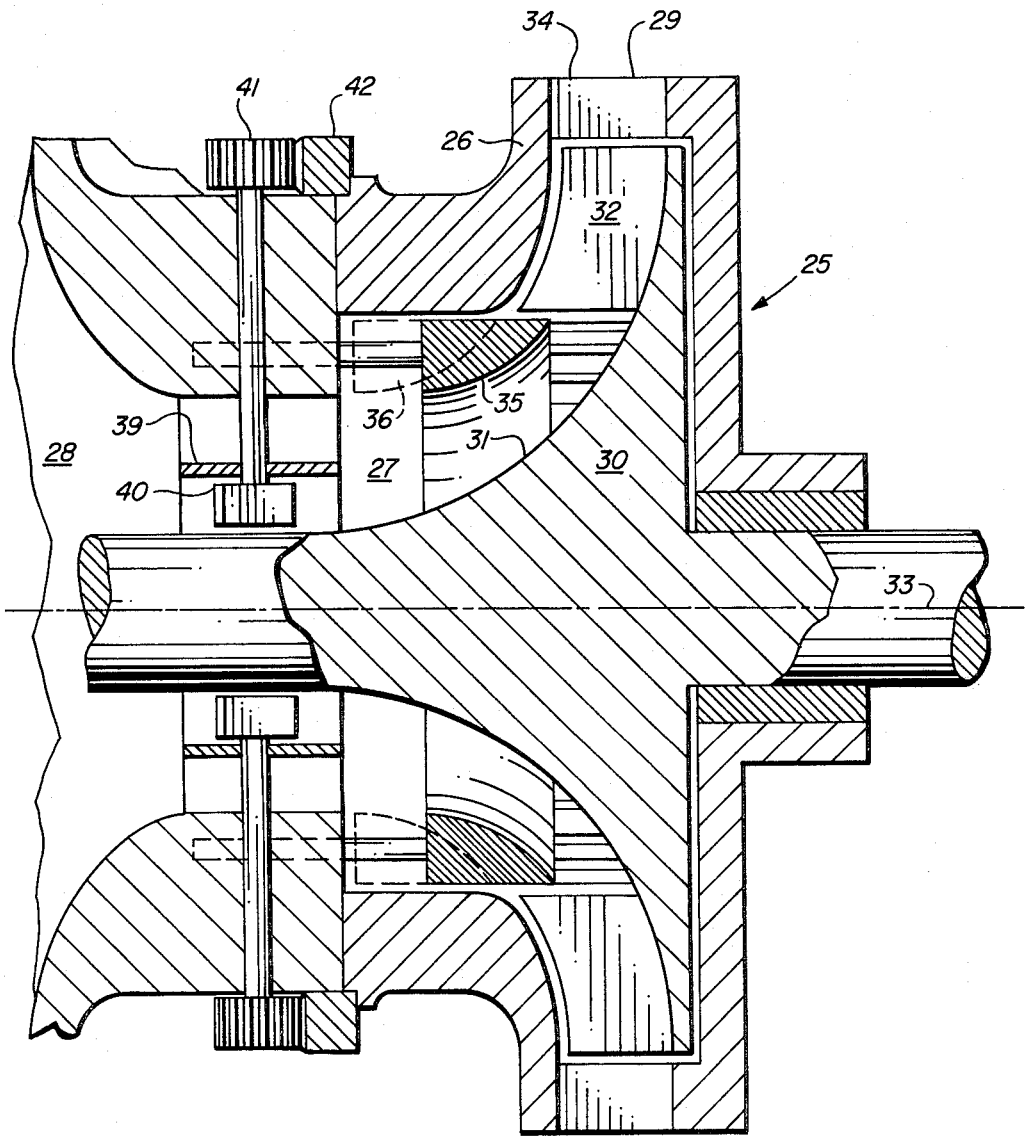
FIG. 3 is a partial axial sectional view, similar to FIG. 1, of a modified form of the invention.

Similar results can be secured in the operation of fan of centrifugal configuration by providing the latter with means for varying the geometry thereof, as shown in FIG. 3. In this Figure, a centrifugal fan 25 is shown in axial section. Fan 25 has casing means 26 providing a passage 27 with an axial inlet 28 at the front and a radially directed outlet 29 at the side. The casing receives a rotor 30 which has a curved surface 31 constituting the inner wall of the fluid passage 27, circumferentially spaced blades 32 projecting from the surface 31 adjacent the periphery of the rotor. The blades 32 are curved in a radial direction so that when the rotor revolves about an axis 33, fluid, such as ambient air, will be drawn into the inlet 28 and discharged by centrifugal force through the outlet 29. The latter may be provided with suitably shaped blades 34, if desired, or found necessary.

In the fan shown in FIG. 3, means for varying the geometry includes a shouud secton 35 which is mounted for axial sliding movement into and out of the path of fluid flowing to the rotor blades 32. The shroud section 35 is, in the form of the invention shown in FIG. 3, shaped somewhat like a ring with a curved surface constituting a continuation of the outer passage wall when the shroud is withdrawn into a chamber 36 therefor formed in the casing. When the shroud is extended it reduces the area of the passage leading to the rotor blades. This positioning of the shroud provides a smooth blockage of flow to the fan and a consequent reduction of fan flow with little effect on pressure rise. It is contended that at a completely closed or zero flow position the pressure rise will be virtually unaffected. The shroud may be moved axially of the casing in any desired manner.

Figure 5:
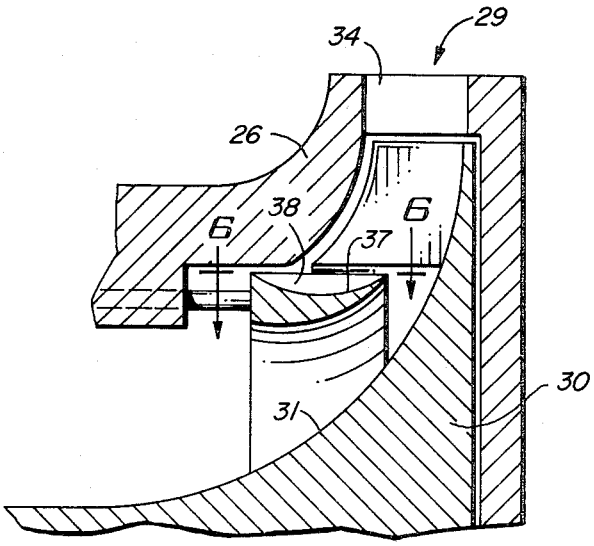
FIG. 5 is a fragmentary sectional view, similar to FIG. 3, showing a further modification.
Figure 6:
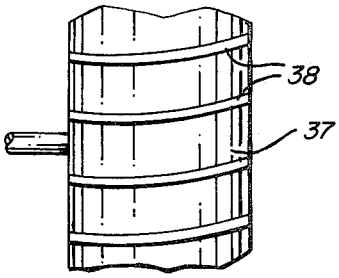
FIG. 6 is a sectional view taken on the line VI—VI of FIG. 5.

The variable inlet section may be modified to improve the performance by recess contouring the surface adjacent the fan blades, as at 37, see FIGS. 5 and 6, and providing curved guiding webs 38 in the recess and extending across it whereby fluid tending to flow backward into the passage from the fan will be recirculated thereinto at an optimum angle.

As in the first form of the invention illustrated, the centrifugal fan of FIG. 3 may be further modified by providing a stall ring 39 adjacent the inlet, see FIG. 3, to divide the fluid drawn into the passage into inner and outer annuluses of flow, one of which may have certain characteristics of flow varied by inlet guide vanes 40. These elements are arranged between the stall ring 39 and one wall of the passage. As in the first form of the invention illustrated, each inlet guide vane is mounted for rotary adjustment about an axis radiating from the axis of rotation 33 of the rotor 30. Each guide vane has a pinion or sector 41 meshing with a ring gear 42 movement of which simultaneously adjusts the angles of the guide vanes and consequently the direction of flow of air to the rotor blades. This adjustment of the guide vanes changes predetermined characteristics of the fluid flow in one of the annuluses of flow through the passage 27.

While the foregoing description is directed more particularly to several forms of the invention parts of which may be utilized either individually or collectively, other forms or modifications may be suggested therein without departing from the principles of the present invention as set forth in the accompanying claims.

I claim:

1. A wide range compressor comprising:

(a) casing means defining a fluid flow passage having an axis, an inlet, and an outlet spaced apart from said inlet along said axis;

(b) rotor means positioned in said passage for inducing fluid flow into said inlet, along said passage and across said rotor means, and out said outlet; and (c) compressor outlet pressure and stall control means positioned in said passage upstream of said rotor means, and defining along an axial portion of said passage a selectively variable, radially inner flow path and a nonvariable radially outer flow path axially coextensive therewith, for inhibiting stall of said compressor by facilitating backflow from said rotor means through said nonvariable radially outer flow path in response to a reduction in the flow rate across said rotor mean, said compressor outlet pressure and stall control means being operable to selectively vary the flow rate through said radially inner flow path to thereby maintain the outlet pressure of said compressor generally constant across substantially the entire flow rate operating range of said compressor.

2. The wide range compressor of claim 1 in which said last-named means include a stall ring and adjustable vane means positioned within said stall ring.

3. The wide range compressor of claim 1 in which said compressor is an axial compressor.

4. The wide range compressor of claim 1 in further comprising axially movable means, positioned between said means (b) and (c), for selectively variably restricting fluid flow through a radially outer portion of said passage downstream from said means (c).

5. The wide range compressor of claim 4 in which said axially movable means comprise a generally ring-shaped shroud circumscribing said axis.

6. The wide range compressor of claim 5 in which said compressor is a centrifugal compressor.

7. A fluid-moving device, such as a compressor, fan, pump or the like, comprising:

(a) inner and outer wall means circumscribing an axis and defining therebetween an annular fluid flow passage having an inlet and an outlet spaced apart from said inlet along said axis;

(b) rotor means positioned in said passage and operative to cause fluid flow therethrough from said inlet to said outlet, said rotor means including a circumferentially spaced series of blades circumscribing said axis, each of said blades extending from adjacent said inner wall means outwardly across said passage toward said outer wall means; and (c) shroud ring means, circumscribing said axis and mounted for selective axial movement within said passage, for blocking fluid flow across a selectively variable outer portion of said annular fuid flow passage to maintain the passage outlet pressure generally constant across substantially the entire flow rate operating range of said device, said shroud ring means being positioned radially inwardly of said series of blades.

8. The fluid-moving device of claim 7 further comprising stall ring means positioned in said passage upstream of said rotor means for facilitating backflow through said passage from said rotor means in response to a reduction in flow rate therethrough to inhibit stall of said device.

9. The fluid-moving device of claim 8 further comprising means for selectively varying the flow rate through the interior of said stall ring means.

10. The fluid-moving device of claim 9 wherein said flow rate varying means include adjustable guide vanes positioned within said stall ring means.

11. The fluid-moving device of claim 7 wherein said fluid-moving device is a centrifugal compressor.

12. The fluid-moving device of claim 11 wherein said blades extend generally axially within said passage.

13. A fluid-moving device comprising:

(a) a casing having an inlet, and outlet, and a passage having an axis and opening outwardly through said inlet and said outlet, said casing having an axially curved wall section defining a radially outer surface of said passage;

(b) a rotor positioned in said passage and operable to move fluid into said inlet, through said passage, and out said outlet;

(c) a stall ring supported within said passage upstream of said rotor, and having an axis generally aligned with said passage axis, to divide an axial portion of fluid flowing through said passage to said rotor into inner and outer flow annuluses relative to said passage axis;

(d) adjustable guide vanes positioned within said stall ring to selectively vary the flow rate therethrough; and (e) a generally ring-shaped shroud positioned in said passage between said stall ring and said outlet and having an axis generally aligned with said passage axis, said shroud having an axially curved radially inner surface and being axially movable between first and second positions to variably restrict a radially outer annular portion of said passage, said radially inner shroud surface generally defining a continuation of said curved wall section of said casing when said shroud is in said first position.

14. A variable geometry fluid-moving apparatus comprising:

(a) casing means having an inlet, an outlet, and inner and outer wall portions defining an annular passage extending through said casing means along an axis and opening outwardly through said inlet and said outlet;

(b) rotor means positioned in said passage and operable to cause fluid flow through said passage from said inlet to said outlet; and (c) means for independently and selectively restricting fluid flow to said rotor means through axially spaced inner and outer annular portions of said passage to inhibit stall of said apparatus and further to maintain the passage outlet pressure generally constant over substantially the entire flow rate operating range of said apparatus, said fluid flow restricting means including an element positioned radially inwardly of blades on said rotor means and supported within said fluid flow passage for selective axial movement therein upstream of said rotor means for selectively restricting an outer annular portion of said passage.

15. The fluid-moving apparatus of claim 14 wherein said fluid flow restricting means further includes a stall ring positioned in said passage upstream of said rotor means and centered about said axis, and means for selectively varying the flow rate through said stall ring.

16. The fluid-moving apparatus of claim 15 where said means for selectively varying the flow rate through said stall ring comprises a circumferentially spaced series of adjustable inlet guide vanes positioned within said stall ring.

17. The fluid-moving apparatus of claim 15 wherein said element is a shroud ring positioned between said stall ring and said rotor means and movable between first and second positions to selectively variably restrict an outer annular portion of said passage.

18. The fluid-moving apparatus of claim 17 wherein said casing means have an outer wall section having an axially curved inner surface portion, and said shroud ring has an axially curved radially inner surface portion, said radially inner surface portion of said shroud ring at least generally defining a continuation of said curved inner surface portion of said outer wall section when said shroud ring is in said first position.

19. A method of maintaining the discharge pressure at an outlet of a fluid-moving device, such as a compressor, fan or the like, at a generally constant level despite substantial variations in the rate of flow of fluid discharged through the outlet, the device having a fluid flow path circumscribing an axis and extending to the outlet, and rotor means in the flow path for moving a fluid therethrough, said method comprising the steps of:

(a) dividing an axial portion of fluid flowing along the flow path upstream of the rotor means into radially inner and outer flow annuluses; and (b) selectively varying the flow rate in only said radially inner flow annulus.

20. The method of claim 19 wherein said step (a) includes positioning a stall ring in the flow passage upstream of the rotor means.

21. The method of claim 20 wherein said step (b) includes the steps of mounting adjustable vanes within said stall ring and selectively adjusting the positions of said vanes.

22. The method of claim 19 further comprising the step of variably radially restricting the area of the flow path between said flow annuluses and the rotor means.

23. The method of claim 22 wherein said last-mentioned step includes the steps of movably positioning a shroud element in the passage and selectively moving said shroud element within the passage.

24. The method of claim 23 wherein said shroud element has a generally ring-like shape and said moving step is performed by axially moving said shroud element in a direction generally parallel to the direction of flow through the device.

25. The invention of claim 5, 7, 12, 13, 17, or 18 wherein said shroud has a radially outer surface in which are formed a plurality of circumferentially spaced, axially extending grooves.

26. The invention of claim 25 wherein said grooves are configured to define curved, axially extending, radially outwardly directed guiding webs between each adjacent pair of said grooves.

* * * * *